United States Patent [19]

Pascus

[11] 4,146,167

[45] Mar. 27, 1979

[54] CARTON CONSTRUCTION

[75] Inventor: Arnold W. Pascus, Mount Prospect, Ill.

[73] Assignee: Elwood Industries, Inc., Chicago, Ill.

[21] Appl. No.: 809,606

[22] Filed: Jun. 24, 1977

[51] Int. Cl.[2] ..... B65D 5/35

[52] U.S. Cl. ..... 229/23 BT; 229/35; 229/45 R; 229/52 AL

[58] Field of Search ..... 229/23 BT, 43, 45 R, 229/52 AL, 32, 35

[56] References Cited

U.S. PATENT DOCUMENTS

| | | | |
|---|---|---|---|
| 1,928,297 | 9/1933 | Mabee | 229/45 R |
| 2,072,371 | 3/1937 | Kaplan | 229/45 R |
| 2,706,595 | 4/1955 | Fallert | 229/45 R |
| 2,970,742 | 2/1961 | Fleisig | 229/45 R |
| 3,140,814 | 7/1964 | Ellis | 229/52 A |
| 3,623,650 | 11/1971 | Watts | 229/45 R |
| 3,653,577 | 4/1972 | Wyner | 229/45 R |
| 3,999,657 | 12/1976 | Doskocil | 229/45 R |

FOREIGN PATENT DOCUMENTS

| | | | |
|---|---|---|---|
| 1124195 | 3/1955 | France | 229/35 |

*Primary Examiner*—William Price
*Assistant Examiner*—Joseph M. Moy
*Attorney, Agent, or Firm*—Wegner, Stellman, McCord, Wiles & Wood

[57] ABSTRACT

A carton construction wherein a container portion is provided with an access opening which is selectively closed by flaps. Tabs are formed from portions of the flaps and are arranged to extend upwardly through suitable corresponding openings in a protective cover which is brought into embracing relationship with the container portion to overlie the flap-closed opening. Adhesive is provided for securing the flaps when deflected into facial engagement with the outer surface of the cover so as to secure the cover to the container portion.

3 Claims, 9 Drawing Figures

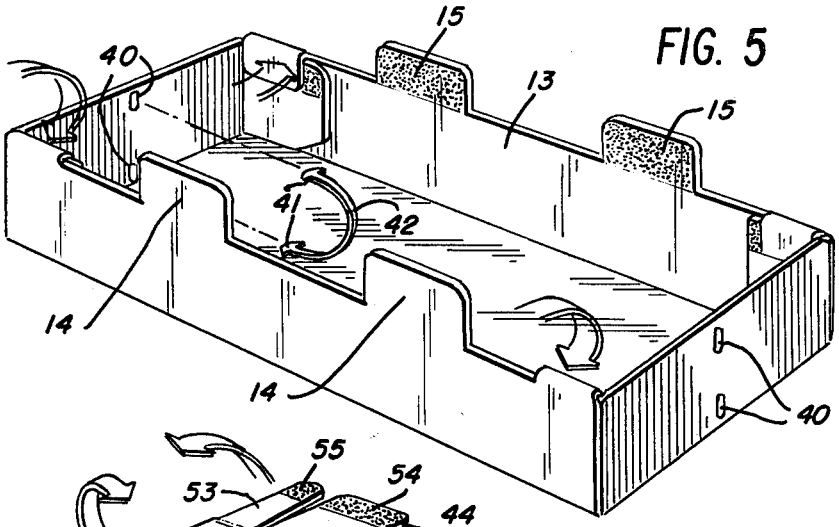
FIG. 5
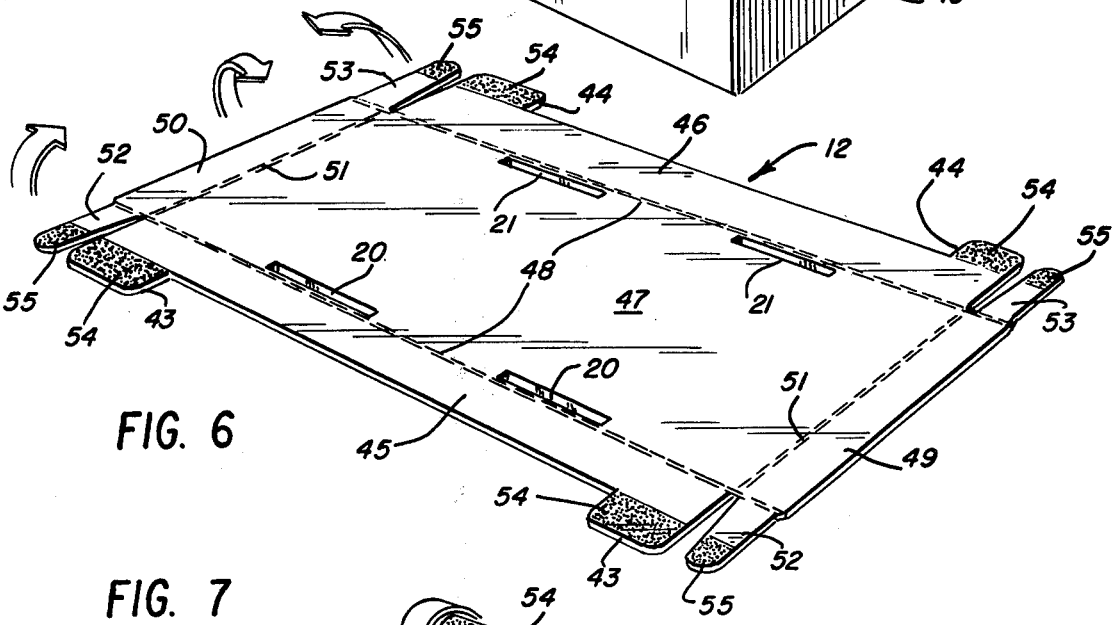
FIG. 6
FIG. 7
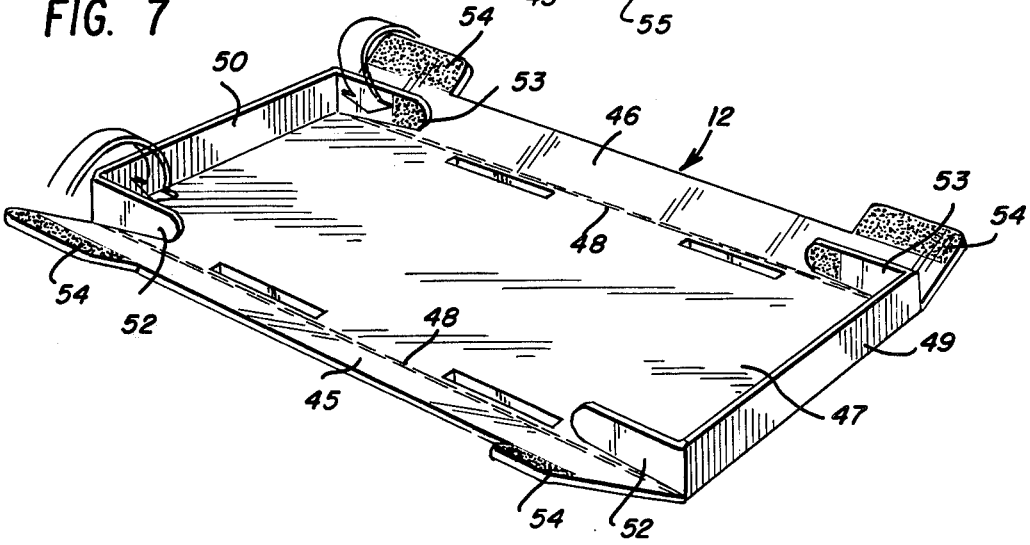

CARTON CONSTRUCTION

BACKGROUND OF THE INVENTION

1. Field of the Invention

This invention relates to carton constructions and in particular to means for securing a protective cover in overlying relationship to a carton container.

2. Description of the Prior Art

In U.S. Pat. No. 3,495,757, of Arnold W. Pascus et al, which patent is owned by the assignee hereof, a cardboard carton is disclosed wherein the carton is formed from a blank which is folded into the desired carton configuration. Corner gussets are provided with locking tabs for cooperation with conplementary locking notches on associated portions of the carton. Other associated portions are provided with adhesive means to secure the closure created when the several panels are folded inwardly upon each other.

It is further conventional to provide a carton constructions, inturned flaps for selectively closing the access opening through the container portion of the carton. A plurality of such flaps may be utilized in interconnected secured relationship to secure the carton in the closed arrangement. Conventionally, such flaps may be secured as by staples, adhesive means, etc.

In another form of carton construction, the container is closed by means of an overlying cover having a depending peripheral portion fitted about the upper edge of the container portion.

SUMMARY OF THE INVENTION

The present invention comprehends an improved carton construction which utilizes a cover for covering the closed opening of a container portion of the carton provided with an opening which is selectively closed by associated flaps on the container. Tab means are provided as movable portions of the flaps permitting them to be projected away from the flaps when the flaps are disposed to close the opening of the container and to extend through suitable openings in the cover. Adhesive means is provided for securing the taps to the cover upon deflection of the tab means from the outwardly projecting disposition into overlying facial engagement with the outer surface of the cover.

The cover may be provided with a depending peripheral flange embracing the container and accurately disposing the openings in the cover in alignment with the upwardly projecting tabs for facilitated assembly of the carton construction.

The tabs may be connected to the container at the edge of the access opening thereto. A score line may be provided at the juncture of the tabs and container to locate the deflection point accurately so as to effectively assure the fully installed arrangement of the cover prior to deflection and adhesive securing of the tabs.

The tabs may be formed in the flaps by suitable scoring thereof permitting the tabs to be urged outwardly from the flaps at the time of closing of the carton construction.

The carton construction of the present invention is extremely simple and economical while yet providing an improved effectively positively secured closed arrangement when desired.

BRIEF DESCRIPTION OF THE DRAWING

Other features and advantages of the invention will be apparent from the following description taken in connection with the accompanying drawing wherein:

FIG. 5 is a perspective view thereof illustrating a third step in the assembly of the container portion;

FIG. 6 is a perspective view of a cut out blank having adhesive applied to projecting tab portions thereof illustrating a first step in the assembly of the cover portion;

FIG. 7 is a perspective view thereof illustrating a second step in the assembly of the cover portion;

FIG. 8 is a perspective view thereof illustrating a third step in the assembly of the cover portion;

DESCRIPTION OF THE PREFERRED EMBODIMENTS

Figures 1, 2:
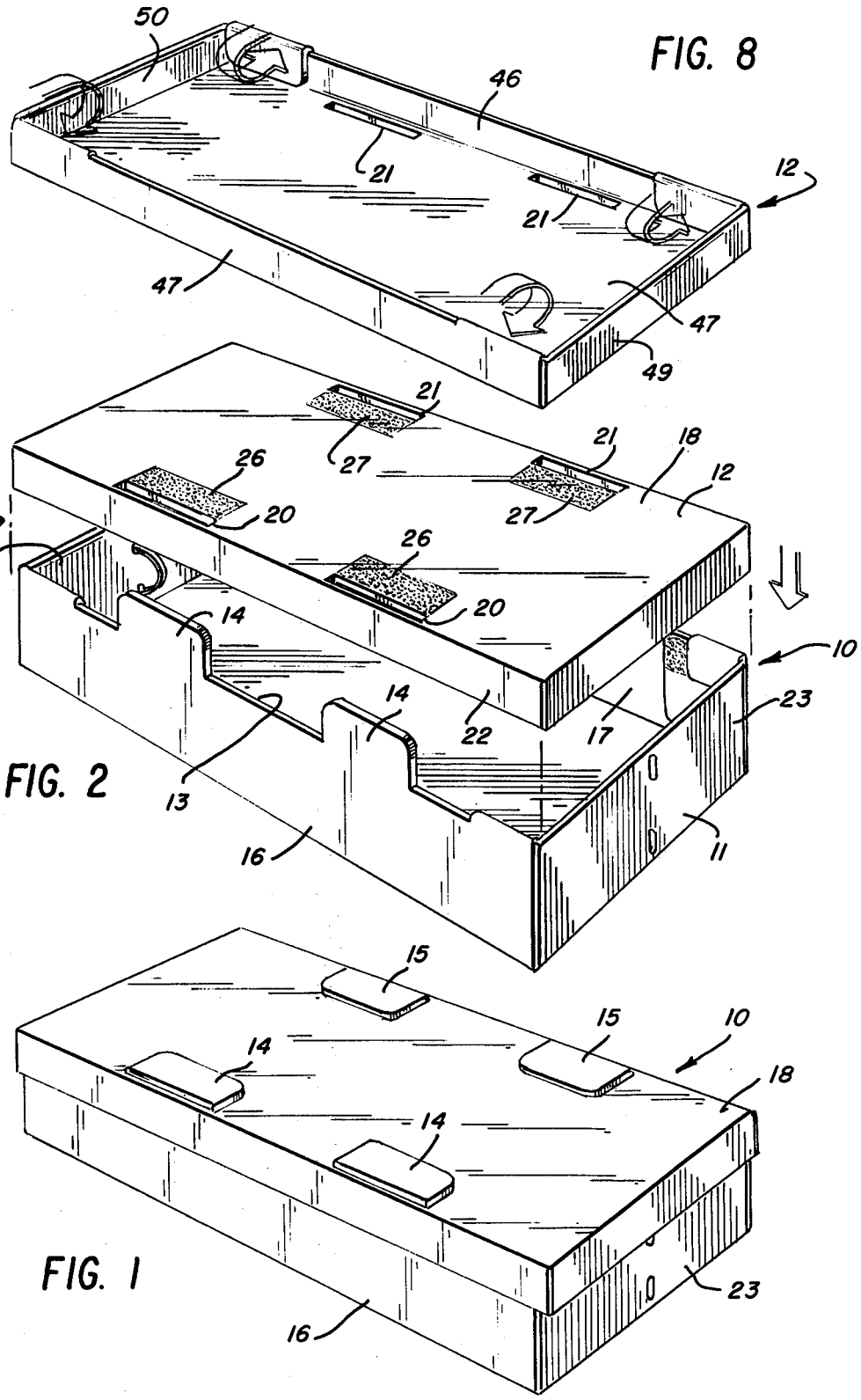
FIG. 1 is a perspective view of a carton construction embodying the invention.
FIG. 2 is a perspective view illustrating the step of installing the cover in the container portion thereof.

In the exemplary embodiment of the invention as disclosed in the drawing, a carton construction generally designated 10 is shown to comprise a container portion 11 and a securing cover 12.

Container portion 11 defines an upper access opening 13. A plurality of tabs 14 and 15 are hingedly connected to the opposite sidewalls 16 and 17, respectively, of the container 11 so as to selectively extend upwardly from the opening 13, as illustrated in FIG. 2.

Cover 12 is arranged to be installed in overlying relationship to the container portion in the assembled arrangement of FIG. 1. The cover is secured to the container by the tabs 14 and 15, as shown in FIG. 1, which are turned into overlying facial secured engagement with the upper surface 18 of the cover.

Figure 3:
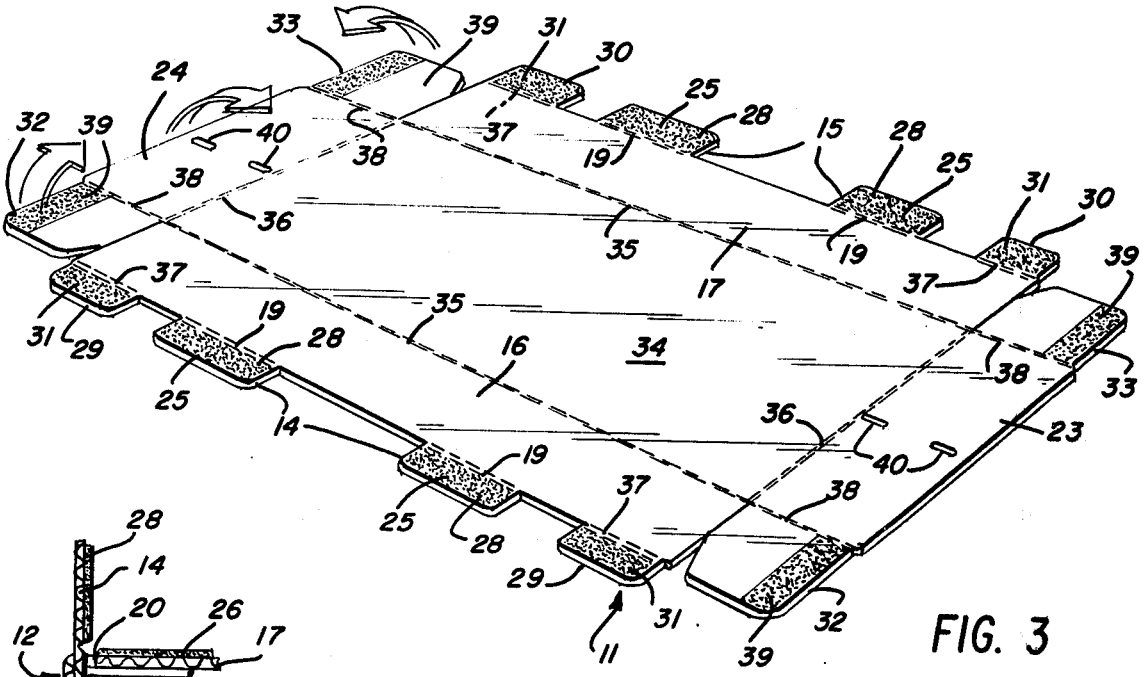
FIG. 3 is a perspective view of a cut out blank having adhesive applied to projecting tab portions thereof illustrating a first step in the assembly of the container portion.

More specifically, as shown in FIGS. 2 and 3, the tabs are defined by movable extensions of the sidewalls 16 and 17 and are hingedly connected to the sidewalls at edge portions of the access opening 13. More specifically, the tabs are connected to the sidewalls by scored hinged portions 19.

The tabs may be formed by suitable cutting operation permitting the tabs to remain substantially coplanar with the sidewalls in the upstanding disposition shown in FIG. 2.

As further illustrated in FIGS. 2 and 3, cover 12 defines pairs of slots 20 and 21 at opposite sides of the cover arranged to be aligned with the upwardly projecting tabs 14 and 15, repsectively, when the cover is brought to an overlying relationship to the container, as shown in FIG. 2. The cover further defines a peripheral depending flange portion 22 adapted to embrace the sidewalls 16 and 17 and end walls 23 and 24 of the container 11 when cover 12 is installed thereover. The embracement of the upstanding walls 16, 17, 23 and 24 by the flange 22 accurately positions cover 12 in centered relationship to container 11 so as to permit facilitated insertion of the tabs 14 and 15 through slots 20 and 21 exemplified by the extension of tab 14 through slot 20 in FIG. 9.

With cover 12 installed on container 11, the tabs may be deflected about the score lines 19 so as to bring an inner surface 25 thereof into overlying facial engagement with the cover top wall 18. As shown in FIG. 2, cover top wall 18 may be provided with adhesive means 26 and 27 adjacent slots 20 and 21, respectively, for securing the tabs to the cover top wall 18 in the deflected, secured condition of FIG. 1.

Figure 4:
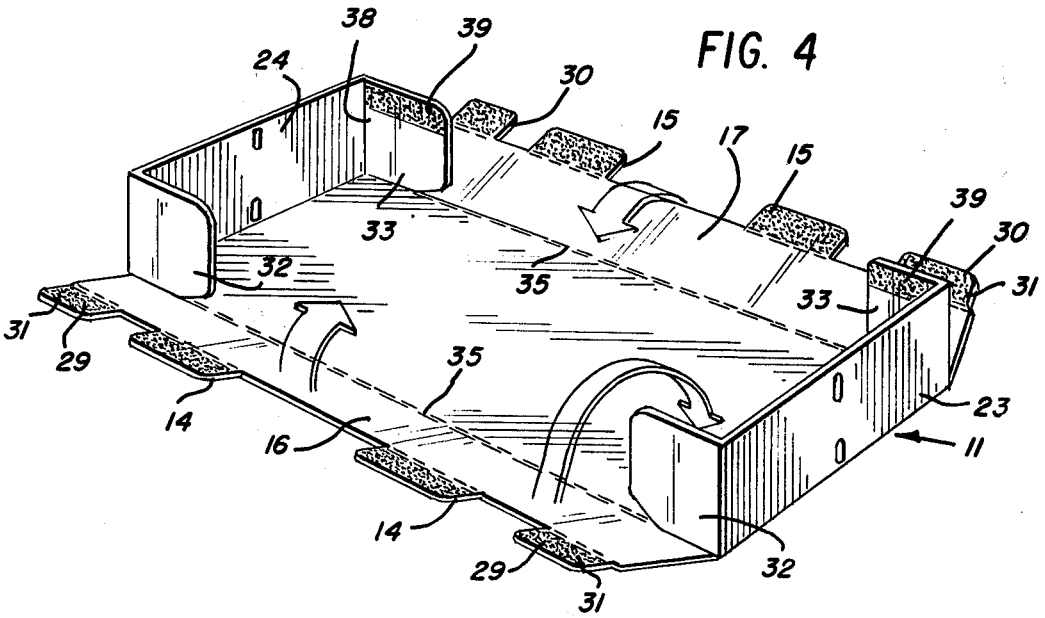
FIG. 4 is a perspective view thereof illustrating a second step in the assembly of the container portion.

As further illustrated in FIG. 4, surface 25 of the tabs may be provided with adhesive means 28 for further improved positive securing of the tabs to the cover in the secured arrangement of FIG. 1. The adhesive means may comprise conventional contact-type adhesive means which provides a positive bond when adhered to itself but generally not to other surfaces so that prior to the facial engagement of the tab adhesive means 28 with the cover adhesive means 26 and 27, each of the adhesive means is substantially inactive, permitting facilitated handling of the carton elements.

Referring now more specifically to FIGS. 3, 4 and 5, container portion 11 of the carton construction may be formed from a flat sheet of suitable material, such as corrugated board material, by suitable cutting and scoring operations. Thus, as shown in FIG. 3, the opposite side edges of the material may be cut to define the tabs 14 and 15 and a second pair of tabs 29 and 30 adjacent the opposite ends of the sidewalls 16 and 17. The container securing tabs 29 and 30 are provided on their inner surface with suitable adhesive 31, as shown in FIG. 3.

End walls 23 and 24 further define laterally extending tabs 32 and 33. Sidewalls 16 and 17 are connected to the bottom wall 34 by scored connecting portions 35 and end walls 23 and 24 are connected to the bottom wall by scored connecting portions 36. Tabs 31 are connected to the sidewalls 16 and 17, respectively, by scored connecting portions 37. Tabs 32 and 33 are connected to the end walls 23 and 24, respectively, by scored connecting portions 38.

Adhesive 39 may be provided on the inner surface of the end tabs 32 and 33, as shown in FIG. 3. As further shown therein, the end walls 23 and 24 may be provided with a pair of slots 40. As shown in FIG. 5, the slots 40 are adapted to receive enlarged end portions 41 of flexible straps 42 which may be formed of suitable material, such as synthetic resin, and of conventional well known construction. Thus, the invention comprehends the selective mounting of a strap 42 to either of the end walls so as to define a garment hanger within the carton construction when desired.

Upon completion of the forming operation and application of the adhesive means as illustrated in FIG. 3, the container portion may be folded about the various score lines, as illustrated in FIG. 4. Thus, the end walls are firstly brought to an upright condition with the end tabs 32 and 33 folded inwardly about the score lines 38 to project vertically upwardly from the score lines 35. As further illustrated in FIG. 4, the sidewalls 16 and 17 are then folded about the score lines 35 to be brought upwardly into engagement with the inturned end tabs 32 and 33.

As illustrated in FIGS. 4 and 5, when the sidewalls 16 and 17 are brought up to the upright position, the securing tabs 29 and 30 are next folded about the top of the end wall tabs 32 and 33 so as to bring the adhesive portions 31 of the securing tabs into facial engagement with the adhesive portions 39 of the end wall tabs. This contact immediately provides a positive, firm securing of the sidewalls and end walls of the container portion of the carton construction in the upright arrangement of FIG. 5. At this time, the strap 42 may be installed if desired.

The forming of the cover 12 is illustrated in FIGS. 6–8. Thus, as shown in FIG. 6, cover 12 may be cut from a suitable web of material, such as corrugated board, with the side edges thereof defining pairs of securing tabs 43 and 44. The depending flange 22 of the cover is defined by a pair of side portions 45 and 46 connected to the top wall 47 of the cover by scored connecting portions 48. The flange 22 is further defined at the ends of the cover construction by end portions 49 and 50 which are connected to the top wall portion 47 by scored connecting portions 51. As indicated above, the cover is further provided with slots 20 and 21 in the cover portion 47 adjacent the scored connecting portions 48.

The end portions 49 and 50 are provided with laterally projecting tabs 52 and 53. Tabs 43 and 44 are provided with adhesive means 54 and tabs 52 and 53 are provided with adhesive means 55.

Referring now more specifically to FIGS. 7 and 8, the cover 12 is formed from the blank illustrated in FIG. 6 by folding up the end portions 49 and 50 with the tabs 52 and 53 turned inwardly to overlie the scored connecting portions 48 at the sides of the top wall 47. The sidewall portions 45 and 46 are then folded upwardly into abutment with the inturned end tabs 52 and 53.

The securing tabs 43 and 44 are then folded about the top edges of the end tabs 52 and 53 so as to bring the adhesive means 54 on the securing tabs into engagement with the adhesive means 55 on the end tabs to secure the flange wall portions in perpendicularly projecting relationship to the top wall 47 of the cover, as shown in FIG. 8.

As indicated briefly above, upon completion of the formation of the container portion 11 and cover portion 12 of the carton construction, the cover may be installed on the container portion by a downward movement of the cover, as illustrated in FIG. 2. As a result of the accurate formation of the tabs 14 amd 15 corresponding to the accurate formation of the slots 20 and 21 in the cover and the accurate fit of the flange 22 of the cover relative to the upright walls of the container portion, the cover may be accurately and rapidly installed on the container portion with the tabs 14 and 15 moving readily upwardly through the slots 20 and 21. Upon completion of such assembly, the upstanding tabs 14 and 15 may be folded over so as to bring the adhesive portions 28 of the container sidewall tabs 14 into facial engagement with the upwardly facing adhesive portions 26 and 27 on the cover top wall surface 12 so as to firmly secure the cover in embracing relationship to the upper portion of the sidewalls of the container as shown in FIG. 1.

Figure 9:
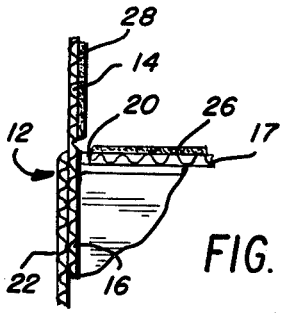
FIG. 9 is a vertical section illustrating the arrangement of the carton construction subsequent to the placement of the cover portion on the container portion but prior to the folding down of the cover securing tabs.

As shown in FIG. 9, the slots in the top wall of the cover may be made to be slightly larger than the upstanding tabs of the container portion so as to readily receive the tabs for facilitated installation of the cover on the container portion of the carton.

As will be obvious to those skilled in the art, the configuration, size and number of tabs of the carton construction may be as desired. The carton construction provides a rigid, strong construction while yet permitting facilitated assembly of both the container and cover portions thereof in the simple manner discussed above. Additionally, the use of the contact adhesive means permits the handling of the container and cover portions with improved facility while yet assuring a positive locked association of the elements of the carton construction in the manner discussed above.

As indicated briefly above, the invention comprehends further the use of a readily installable hanger when desired by means of the provision of the slots 40 in the opposite end walls of the container portion of the carton. The illustrated strap 42, being flexible, may be installed by a simple twisting action with the end portions 41 thereof being inserted lengthwise of the slots and then turned to extend transversely thereto in the conventional manner. As will be obvious to those skilled in the art, where the carton is utilized with such straps as for hanging garments therein, suitable markings may be provided on the carton to indicate the preferred orientation of the carton in shipment and storage.

The foregoing disclosure of specific embodiments is illustrative of the broad inventive concepts comprehended by the invention.

I claim:

1. A parallelepiped carton construction comprising:

a parallelepiped container having a bottom wall and sidewalls folded upwardly therefrom and provided with securing tabs having first dry contact adhesive means adhered to each other to form said sidewalls into a peripheral upstanding wall of the container defining an upper opening for providing access to the interior thereof, said peripheral wall defining an upper edge and the exterior thereof being free of exposed adhesive means;

a plurality of spaced cover tabs defined by movable extensions of said upper edge of said container peripheral wall;

a parallelepiped cover for closing the container opening having an upper wall defining an upper surface and slots for extension of said cover tabs therethrough when said cover is disposed to cover said container opening, and depending sidewalls;

and second dry contact adhesive means on each of said container cover tabs and cover upper surface for securing the cover tabs to said cover upon deflection of said cover tabs from an upwardly projecting extension through said slots into overlying facial engagement with said cover upper surface, said second dry contact adhesive means defining substantially congruent areas on said tabs and cover, the second dry contact adhesive means on said cover upper surface being the only adhesive means exposed outwardly of the assembled container and cover prior to the deflection of said tabs, no adhesive means being exposed outwardly of the assembled container and cover subsequent to said deflection, said container securing tabs including cooperating pairs at the corners of the container, one of said cooperating securing tabs being folded about a vertical fold line to lie within the adjoining sidewall portion and the other of said cooperating securing tabs being folded along said peripheral wall upper edge to facially inwardly engage said folded one of said securing tabs, the first adhesive means being disposed on the facially engaging surface thereof, said peripheral wall being free of adhesive whereby the container is retained in the parallelepiped configuration solely by the adhesive securing of the securing tab pairs to each other at said corners of the container, said cover further defining corners, said depending sidewalls being provided further with securing tabs at the corners, said cover securing tabs including cooperating pairs one of which is folded about a vertical fold line to lie within the adjoining sidewall portion and the other of which is folded along the sidewall distal edge to engage facially inwardly said folded one of said cover securing tabs, contact adhesive means being disposed on the facially engaging surfaces of said paired cover corner tabs whereby the cover is retained in a parallelepiped configuration solely by the adhesive securing of the cover securing tab pairs to each other at the corners of the cover.

2. The carton construction of claim 1 wherein said cover tabs comprise a pair of tabs at each of the opposite sides of said container.

3. The carton construction of claim 1 wherein said container peripheral wall is provided with a pair of juxtaposed aligned slits, and a flexible strap is secured to said sidewall by means of flat enlarged end portions of the strap being inserted edgewise through the slits and subsequently turned to be interlocked with the sidewall in said juxtaposed aligned slits with said strap end portions exposed outwardly of the carton construction.

* * * * *